US011542114B2

(12) United States Patent
Suzuki

(10) Patent No.: US 11,542,114 B2
(45) Date of Patent: Jan. 3, 2023

(54) POST-PROCESSING DEVICE AND IMAGE FORMING APPARATUS

(71) Applicant: FUJIFILM Business Innovation Corp., Tokyo (JP)

(72) Inventor: Masatoshi Suzuki, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/403,155

(22) Filed: Aug. 16, 2021

(65) Prior Publication Data

US 2022/0371851 A1 Nov. 24, 2022

(30) Foreign Application Priority Data

May 21, 2021 (JP) ..... JP2021-086306

(51) Int. Cl.
*B65H 37/04* (2006.01)
*B65H 31/00* (2006.01)
*B65H 43/04* (2006.01)

(52) U.S. Cl.
CPC ..... *B65H 37/04* (2013.01); *B65H 31/00* (2013.01); *B65H 43/04* (2013.01)

(58) Field of Classification Search
CPC ..... B65H 2408/122; B65H 2408/1222
See application file for complete search history.

(56) References Cited

U.S. PATENT DOCUMENTS 5,290,020 A * 3/1994 Matsui ..... B42B 4/00 227/111
6,264,194 B1 * 7/2001 Hayashi ..... B65H 31/3027 271/220
6,568,669 B2 * 5/2003 Hosaka ..... B27F 7/17 227/100
6,641,129 B2 * 11/2003 Ogita ..... B42C 1/12 399/407
6,837,840 B2 * 1/2005 Yonekawa ..... B65H 45/18 493/449
7,434,796 B2 * 10/2008 Kushida ..... B42B 4/00 270/58.08
7,862,023 B2 * 1/2011 Ichihashi ..... B42C 1/12 270/58.08
7,866,648 B2 * 1/2011 Noh ..... G03G 15/6544 270/58.11
9,738,481 B2 * 8/2017 Lee ..... B65H 31/26
(Continued)

FOREIGN PATENT DOCUMENTS

JP 2013-95555 A 5/2013

*Primary Examiner* — Leslie A Nicholson, III
(74) *Attorney, Agent, or Firm* — Oliff PLC

(57) ABSTRACT

A post-processing device includes: a passage that extends in one direction; a post-processing section that is movable on a plane along the passage and that is stopped at plural post-processing positions, including a stop position determined in advance, to perform post-processing on a recording medium; and a positioning portion which is provided at the stop position and against which an end portion of the recording medium abuts when the post-processing section performs the post-processing at a post-processing position other than the stop position, the positioning portion being retracted with respect to the post-processing section when the post-processing section passes through the stop position or is moved toward the stop position.

5 Claims, 17 Drawing Sheets

(56) References Cited

U.S. PATENT DOCUMENTS

| | | | | |
|---|---|---|---|---|
| 10,987,890 | B2 * | 4/2021 | Terao | B65H 37/04 |
| 10,987,964 | B2 * | 4/2021 | Noguchi | B42B 5/00 |
| 11,066,268 | B2 * | 7/2021 | Shibasaki | B65H 31/34 |
| 2019/0283358 | A1 * | 9/2019 | Terao | B31F 5/02 |
| 2019/0291496 | A1 * | 9/2019 | Noguchi | B65H 29/12 |
| 2020/0307944 | A1 * | 10/2020 | Shibasaki | B65H 31/34 |

* cited by examiner

POST-PROCESSING DEVICE AND IMAGE FORMING APPARATUS

CROSS-REFERENCE TO RELATED APPLICATIONS

This application is based on and claims priority under 35 USC 119 from Japanese Patent Application No. 2021-086306 filed May 21, 2021.

BACKGROUND

(i) Technical Field

The present disclosure relates to a post-processing device and an image forming apparatus.

(ii) Related Art

There has hitherto been known a post-processing device that staples (binds) a plurality of pieces of recording paper aligned and loaded thereon (see Japanese Unexamined Patent Application Publication No. 2013-95555, for example). In the post-processing device, a stapler is configured to be movable from the back side to the front side of the device body to enable stapling at multiple positions.

SUMMARY

Aspects of non-limiting embodiments of the present disclosure relate to providing a post-processing device and an image forming apparatus that allow a recording medium to be positioned in post-processing performed by a post-processing section that stops at a post-processing position other than a stop position, without obstructing movement of the post-processing section through or toward the stop position.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a post-processing device including: a passage that extends in one direction; a post-processing section that is movable on a plane along the passage and that is stopped at a plurality of post-processing positions, including a stop position determined in advance, to perform post-processing on a recording medium; and a positioning portion which is provided at the stop position and against which an end portion of the recording medium abuts when the post-processing section performs the post-processing at a post-processing position other than the stop position, the positioning portion being retracted with respect to the post-processing section when the post-processing section passes through the stop position or is moved toward the stop position.

BRIEF DESCRIPTION OF THE DRAWINGS

An exemplary embodiment of the present disclosure will be described in detail based on the following figures, wherein.

DETAILED DESCRIPTION

An exemplary embodiment of the present disclosure will be described below with reference to the drawings. In the following, features that are necessary to address the issue of the present disclosure will be described schematically, and features that are necessary to describe the corresponding portions of the present disclosure will be described principally. Features not described should be construed on the basis of the related art.

<Image Forming Apparatus>

Figure 1:
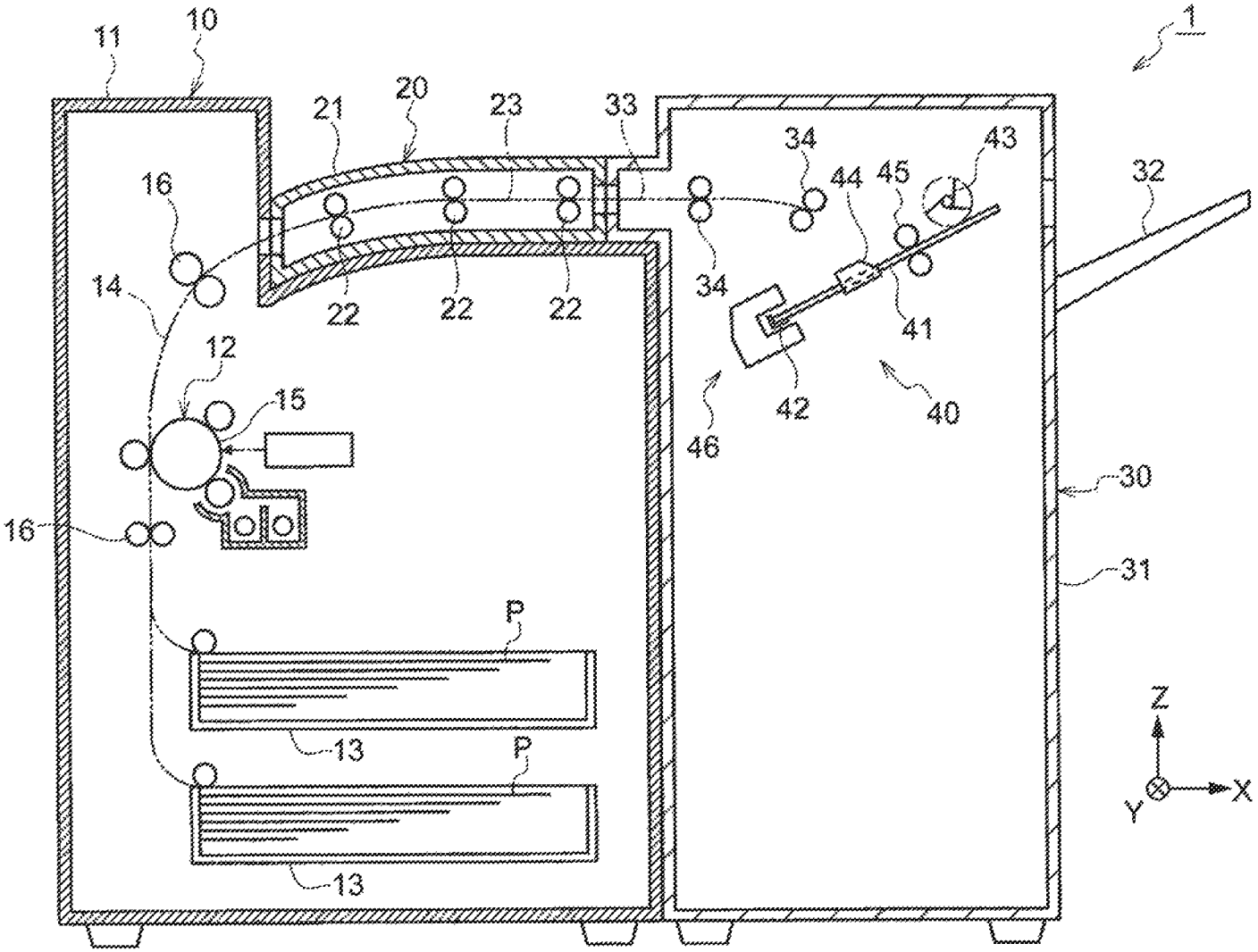
FIG. 1 schematically illustrates an example of an image forming apparatus according to an exemplary embodiment of the present disclosure.

FIG. 1 schematically illustrates an example of an image forming apparatus according to an exemplary embodiment of the present disclosure. As illustrated in FIG. 1, an image forming apparatus 1 according to the present exemplary embodiment may include an image forming unit 10, a transport unit 20, and a post-processing unit 30. In the following, the X direction, the Y direction, and the Z direction indicated in FIG. 1 are prescribed as the horizontal direction, the depth direction, and the height direction, respectively. The image forming unit 10 is an example of the image forming unit. The post-processing unit 30 is an example of the post-processing device.

The image forming unit 10 may include an image forming unit body 11. An image forming section 12 and two paper storage sections 13 may be disposed in the image forming unit body 11. A transport path 14 may be provided in the image forming unit body 11.

The image forming section 12 forms an image on paper P (or a paper bundle PB) as an example of the recording medium. The image forming section 12 may form an image on the paper P through electrophotography in which an image is formed by transferring a toner image attached in advance to a photoconductor drum 15 to the paper P. The method of image formation by the image forming section 12 is not limited to the electrophotography described above, and an inkjet system in which an image is formed by dispensing inks onto the paper P etc. may be used, for example. The paper P is generally paper. However, the paper P may be other printable materials such as a film-like material, for example.

The two paper storage sections 13 store pieces of paper P of different sizes and types in a stacked manner. The pieces of paper P stored in each of the paper storage sections 13 are supplied to the image forming section 12, one piece at a time. The number of the paper storage sections 13 is not limited to two, and may be one or three or more.

The transport path 14 is used to transport the paper P to a desired position in the image forming unit 10. The transport path 14 is used to transport the paper P, which has been supplied from the paper storage section 13 and on which an image has been formed by the image forming section 12, to eject the paper P out of the image forming unit body 11. A plurality of transport rollers 16 are disposed at appropriate locations in the transport path 14.

The transport unit 20 includes a transport unit body 21. A plurality of transport rollers 22 are disposed in the transport unit body 21. The transport unit 20 is disposed so as to connect between a paper ejection port of the image forming unit 10 and a paper inlet port of the post-processing unit 30. A transport path 23 for transporting the paper P, which has been ejected from the image forming unit 10, into a post-processing unit body 31 is provided in the transport unit 20. A hole forming device (not illustrated) that forms a hole in the paper P may be disposed in the transport unit 20.

<Post-processing Device>

The post-processing unit 30 as an example of the post-processing device is provided downstream of the image forming unit 10 in the transport direction of the paper P, and includes the post-processing unit body 31. A binding unit 40 is disposed in the post-processing unit body 31. The binding unit 40 is provided to bind the plurality of pieces of paper P. An ejection section 32, to which the paper P or the paper bundle PB which has been bound by the binding unit 40 is ejected, is mounted to the post-processing unit body 31. A transport path 33 that includes a plurality of transport rollers 34 is formed in the post-processing unit body 31. The paper P which has been transported into the post-processing unit body 31 is transported to the binding unit 40 through the transport path 33.

The binding unit 40 may include a loading plate 41, an abutment member 42, a paddle 43, a tamper 44, an ejection roller 45, and a binding device 46. The loading plate 41 may be a plate-like member onto which the paper P which has been transported from the transport path 33 is loaded. The loading plate 41 is disposed as inclined by a desired angle (e.g. about 30°) such that an end portion of the loading plate 41 on the side on which the binding device 46 is positioned is positioned below an end portion thereof on the opposite side. The abutment member (also called an "end wall") 42 is provided at an end portion of the loading plate 41 on the side on which the binding device 46 is provided. End portions of the plurality of pieces of paper P on the rear side in the transport direction abut against the abutment member 42 so that the plurality of pieces of paper P are aligned in position in the transport direction. As discussed above, the loading plate 41 is inclined by a desired angle. Therefore, the paper P which has been transported onto the loading plate 41 is easily movable toward the abutment member 42 by its own weight. The abutment member 42 according to the present exemplary embodiment includes a fixed abutment member 80 and a movable abutment member 90, and will be discussed in detail later. The paddle 43 is provided on the upper surface side of the loading plate 41. The paddle 43 is rotated by a drive force received from a drive source (not illustrated) to contact a surface of the paper P which has been transported onto the loading plate 41 and push the paper P toward the abutment member 42. The tamper 44 is movable in a direction (hereinafter referred to a "width direction (of the paper P)") of crossing the transport direction of the plurality of pieces of paper P along the depth direction, and operates so as to clamp both end portions of the paper P in the width direction to align the plurality of pieces of paper P (paper bundle PB) in the width direction. The ejection roller 45 is operable so as to eject the paper bundle PB after being bound by the binding device 46, to be discussed later, to the ejection section 32.

Figure 2:
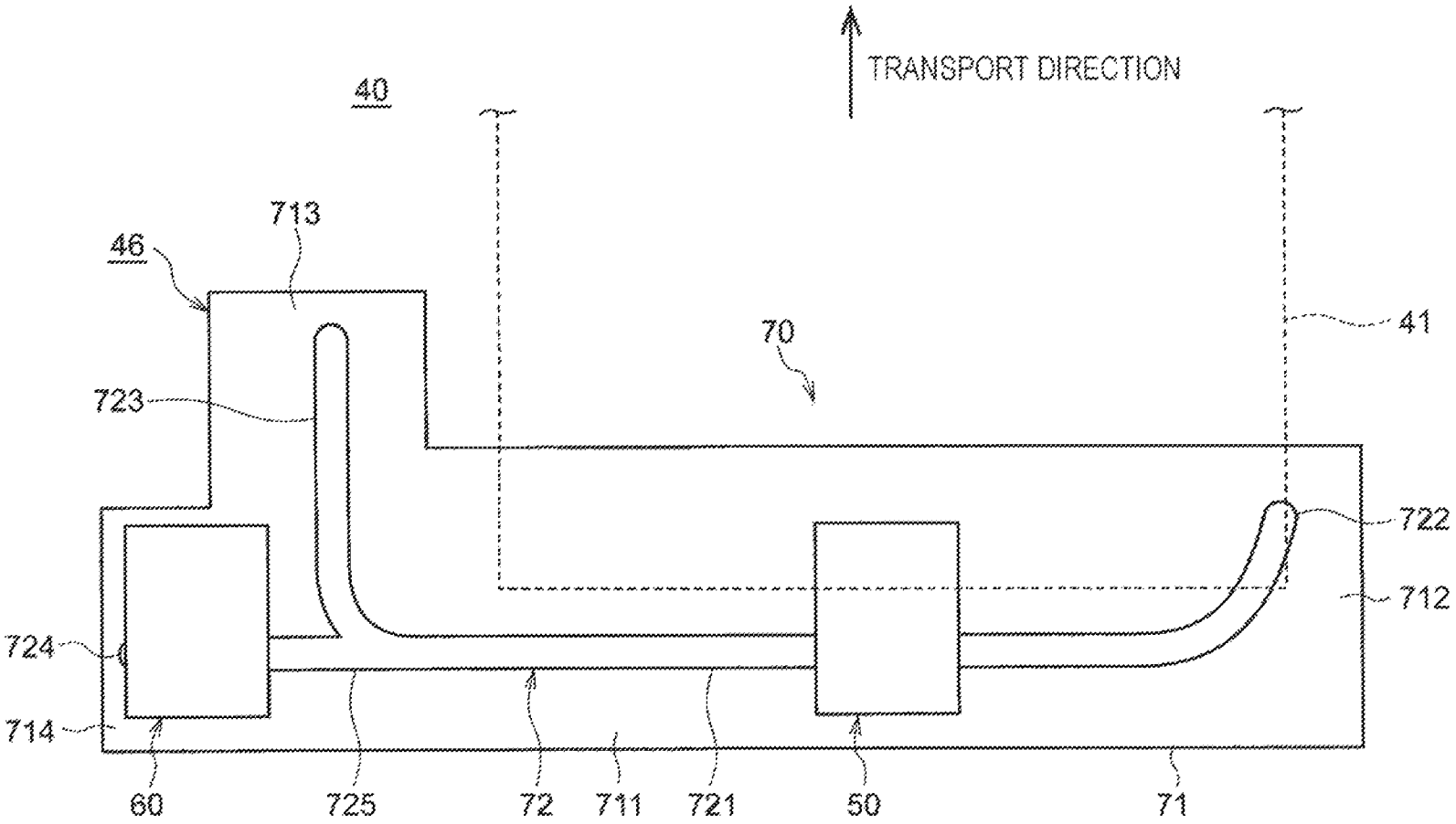
FIG. 2 is a schematic plan view illustrating a binding unit of the image forming apparatus illustrated in FIG. 1.

FIG. 2 is a schematic plan view illustrating the binding unit 40 of the image forming apparatus 1 illustrated in FIG. 1. While the entire binding unit 40 is inclined by a desired angle with respect to the horizontal direction as discussed above, FIG. 2 is illustrated with a surface seen in a direction that is orthogonal to the direction of extension of the binding unit 40 prescribed as a plane. The binding device 46 of the binding unit 40 according to the present exemplary embodiment is able to execute a plurality of types of binding processes, as an example of the post-processing, at one or more locations at an end portion, on the side of the abutment member 42, of a plurality of pieces of paper P (i.e. a paper bundle PB) loaded on the loading plate 41. Accordingly, in the binding device 46 according to the present exemplary embodiment, a staple binding member 50 that binds the plurality of pieces of paper P using a staple (needle) and a stapleless binding member 60 that binds the plurality of pieces of paper P without using a staple are supported on a movable body support member 70. The staple binding member 50 is an example of the post-processing section. The stapleless binding member 60 is an example of the second post-processing section.

The movable body support member 70 may include a support plate 71 and a guide rail 72 formed on the support plate 71. A flat plate member that is elongated in the depth direction may be principally adopted as the support plate 71. The support plate 71 is preferably composed of: a body portion 711 which is positioned at a middle portion, in the longitudinal direction, of the support plate 71 and in which the guide rail 72 extending in the depth direction is formed; an initial portion 712 that is a portion of the support plate 71 positioned on the front side in the depth direction and that includes at least an initial position P1 (see FIG. 5) of the staple binding member 50 and the stapleless binding member 60; a first stand-by portion 713 positioned on the back side in the depth direction of the support plate 71, extending in a direction intersecting the direction of extension of the body portion 711, and including at least a first stand-by position P2 (see FIG. 5) at which the staple binding member 50 stands by when not in use; and a second stand-by portion 714 positioned on the back side in the depth direction of the support plate 71, extending in the same direction as the direction of extension of the body portion 711, and including at least a second stand-by position P3 (see FIG. 5) at which the stapleless binding member 60 stands by when not in use. The staple binding member 50 and the stapleless binding member 60 are moved on the plane of the support plate 71. The guide rail 72 is an example of the passage. The first stand-by position is an example of the stand-by position. The second stand-by position is an example of the second stand-by position.

The guide rail 72 may be formed as a long hole that vertically penetrates the surface of the support plate 71. The guide rail 72 may include: a principal guide path 721 principally provided in the body portion 711 of the support plate 71 and extending in the depth direction (corresponding to the one direction) along a side that constitutes an end surface of the paper P stacked on the loading plate 41; a curved path 722 principally provided in the initial portion 712 of the support plate 71 and extending as curved toward the transport direction from an end portion of the principal guide path 721 on the front side in the depth direction (corresponding to the one side in the one direction); a first stand-by path 723 principally provided in the first stand-by portion 713 of the support plate 71 and extending as curved toward the transport direction which intersects the depth direction from a branched path 725 formed at an end portion of the principal guide path 721 on the back side; and a second stand-by path 724 principally provided in the second stand-by portion 714 of the support plate 71 and extending further toward the back side in the depth direction (corresponding to the other side in the one direction) from the branched path 725. As discussed above, the first stand-by path 723 and the second stand-by path 724 are branched into different directions at the branched path 725. A location around an end portion of the first stand-by path 723 corresponds to the first stand-by position P2, and a location around an end portion of the second stand-by path 724 corresponds to the second stand-by position P3 (see FIG. 5).

Figure 3:
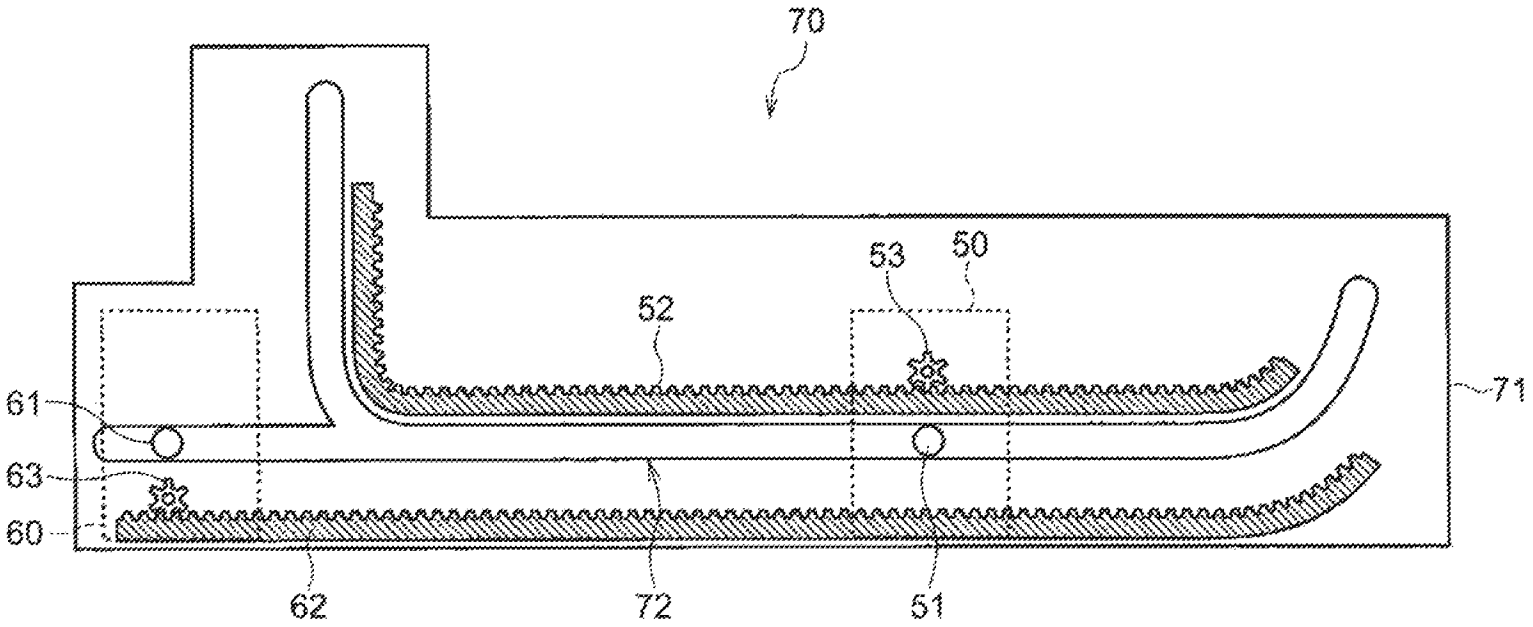
FIG. 3 is a schematic view illustrating the movement structure of a staple binding member and a stapleless binding member of the binding unit illustrated in FIG. 2.
Figure 4:
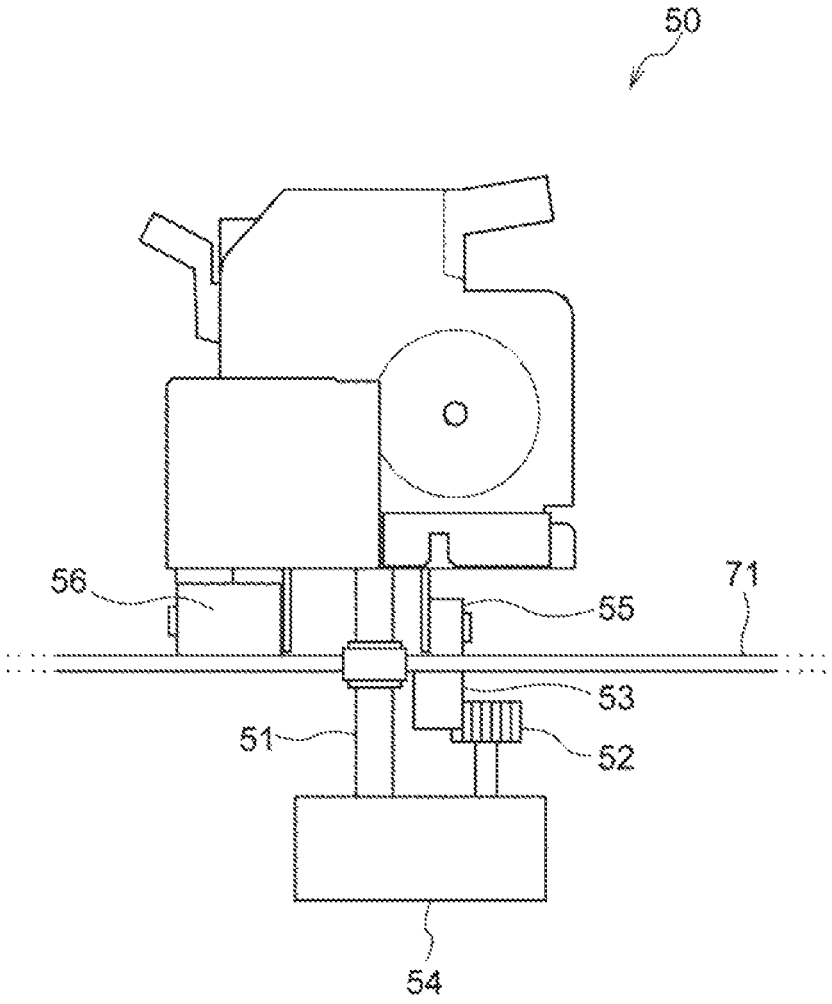
FIG. 4 illustrates a portion of the staple binding member of the binding unit illustrated in FIG. 2 as seen from a side.

FIG. 3 is a schematic view illustrating the movement structure of the staple binding member and the stapleless binding member of the binding unit illustrated in FIG. 2, illustrating a part of the support plate as transparent in order to illustrate the structure of the back side of the support plate. FIG. 4 illustrates a portion of the staple binding member of the binding unit illustrated in FIG. 2 as seen from a side. In the binding device 46 according to the present exemplary embodiment, as illustrated in FIGS. 2 to 4, the staple binding member 50 and the stapleless binding member 60 are moved along the guide rail 72. Particularly, the staple binding member 50 is moved along a path prescribed by the curved path 722, the principal guide path 721, the branched path 725, and the first stand-by path 724 on the guide rail 72. Consequently, the staple binding member 50 is reciprocally movable between the first stand-by position P2 (see FIG. 5) and the initial position P1 (see FIG. 5). In order to implement such movement, the staple binding member 50 may include a staple-side insertion pin 51, a staple-side rack 52, a staple-side pinion 53, a staple-side drive portion 54, a staple-side inner wheel 55, and a staple-side outer wheel 56, as particularly illustrated in FIGS. 3 and 4.

The staple-side insertion pin 51 is inserted into the guide rail 72 to guide the direction of movement of the staple binding member 50. The staple-side rack 52 is constituted as a rack gear provided along the path of movement of the staple binding member 50 discussed above on the back surface side of the support plate 71. The staple-side pinion 53 is constituted as a pinion gear to be meshed with the staple-side rack 52. The staple-side drive portion 54 includes a drive source such as a motor, and is fixed to the staple-side insertion pin 51 to supply a drive force to the staple-side pinion 53.

One or more, e.g. two, staple-side inner wheels 55 are rotatably provided on the lower surface of the staple binding member 50 to turn at a position on the inner side of the guide rail 72 (on the side of the transport direction) on the upper surface of the support plate 71 while supporting the staple binding member 50. One or more, e.g. two, staple-side outer wheels 56 are rotatably provided on the lower surface of the staple binding member 50 to turn at a position on the outer side of the guide rail 72 (on the opposite side from the transport direction) on the upper surface of the support plate 71 while supporting the staple binding member 50. The staple binding member 50 configured as discussed above is moved along the staple-side rack 52 with the staple-side inner wheel 55 and the staple-side outer wheel 56 turned by actuating the staple-side drive portion 54 to rotate the staple-side pinion 53.

The stapleless binding member 60 is moved along a movement path prescribed by the curved path 722, the principal guide path 721, the branched path 725, and the second stand-by path 724 on the guide rail 72. Consequently, the stapleless binding member 60 is reciprocally movable between the second stand-by position P3 (see FIG. 5) and the initial position P1 (see FIG. 5). The stapleless binding member 60 is also moved along the movement path by including drive components that are similar to those of the staple binding member 50. That is, the stapleless binding member 60 may be configured to include a stapleless-side insertion pin 61, a stapleless-side rack 62, a stapleless-side pinion 63, a stapleless-side drive portion (not illustrated), a stapleless-side inner wheel (not illustrated), and a stapleless-side outer wheel (not illustrated). The details of such drive components are similar to those of the staple binding member 50, and thus are not described. The drive components of the staple binding member 50 and the stapleless binding member 60 discussed above are not limited to those discussed above as long as the staple binding member 50 and the stapleless binding member 60 are movable along the guide rail 72, and may be changed to different components.

Figure 5:
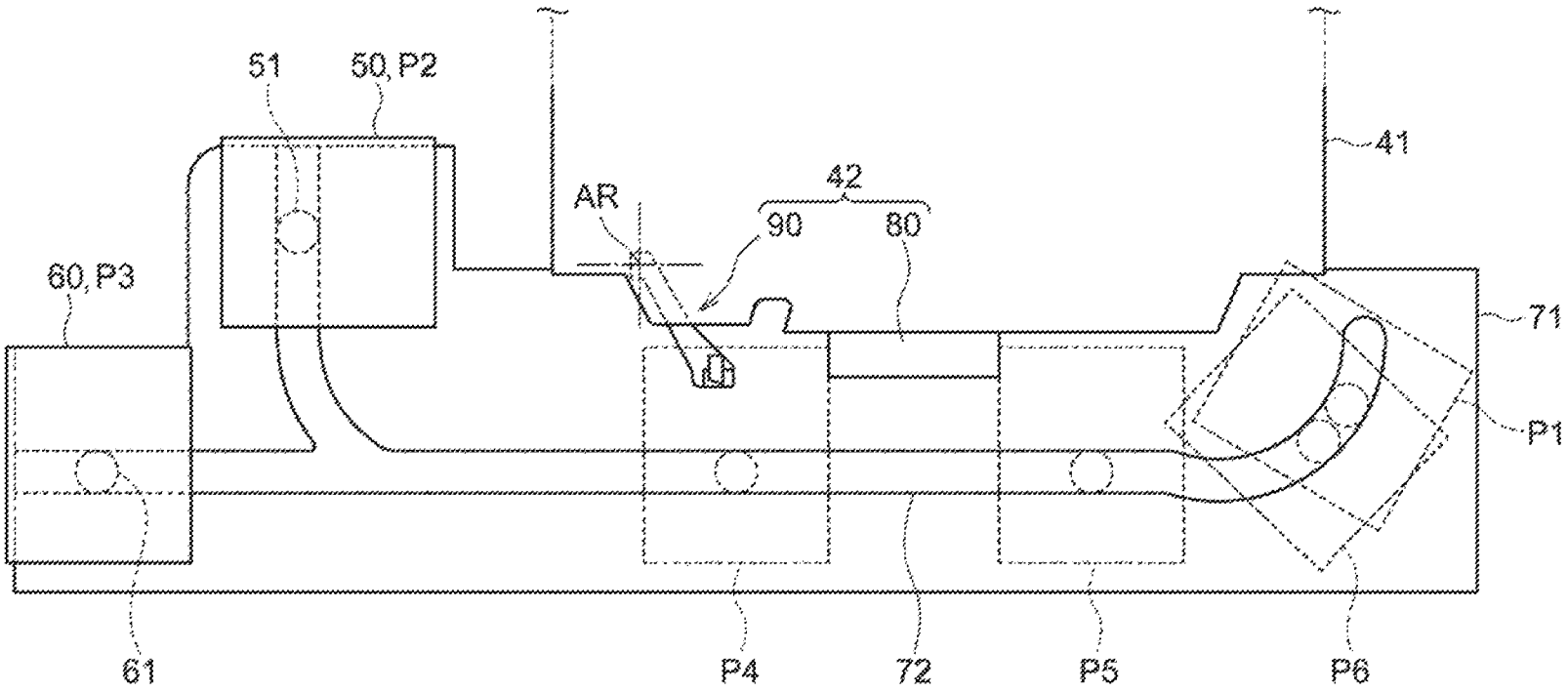
FIG. 5 is a schematic view illustrating the positions at which the staple binding member and the stapleless binding member of the binding unit illustrated in FIG. 2 are to be stopped.

FIG. 5 is a schematic view illustrating the positions at which the staple binding member and the stapleless binding member of the binding unit illustrated in FIG. 2 are to be stopped. As illustrated in FIG. 5, the staple binding member 50 and the stapleless binding member 60 are moved along the guide rail 72, and stopped at a plurality of positions set in advance. The positions for stoppage may include: the initial position P1 which is positioned on the initial portion 712 and at which the staple binding member 50 and the stapleless binding member 60 execute binding operation; the first stand-by position P2 at which the staple binding member 50 stands by in order not to obstruct movement of the stapleless binding member 60 when the stapleless binding member 60 executes binding operation; the second stand-by position P3 at which the stapleless binding member 60 stands by in order not to obstruct movement of the staple binding member 50 when the staple binding member 50 executes binding operation; a first binding position P4 and a second binding position P5 for flat binding at two adjacent locations along a side of the paper bundle PB that abuts against the abutment member 42; and a third binding position P6 for oblique binding at a corner portion on the side of the paper bundle PB that abuts against the abutment member 42. Both the staple binding member 50 and the stapleless binding member 60 are stopped at the initial position P1 and the first to third binding positions P4 to P6, among these positions. In the present exemplary embodiment, only the third binding position P6 at which the left corner portion of the paper bundle PB (paper P) in the drawing is to be bound is indicated as an example of the position for oblique binding of the paper bundle PB. However, a stop position at which the right corner portion of the paper bundle PB in the drawing is to be bound may also be provided separately. The first to third binding positions P4 to P6 are examples of the post-processing position. The first binding position P4 is also an example of the stop position.

Figure 6:
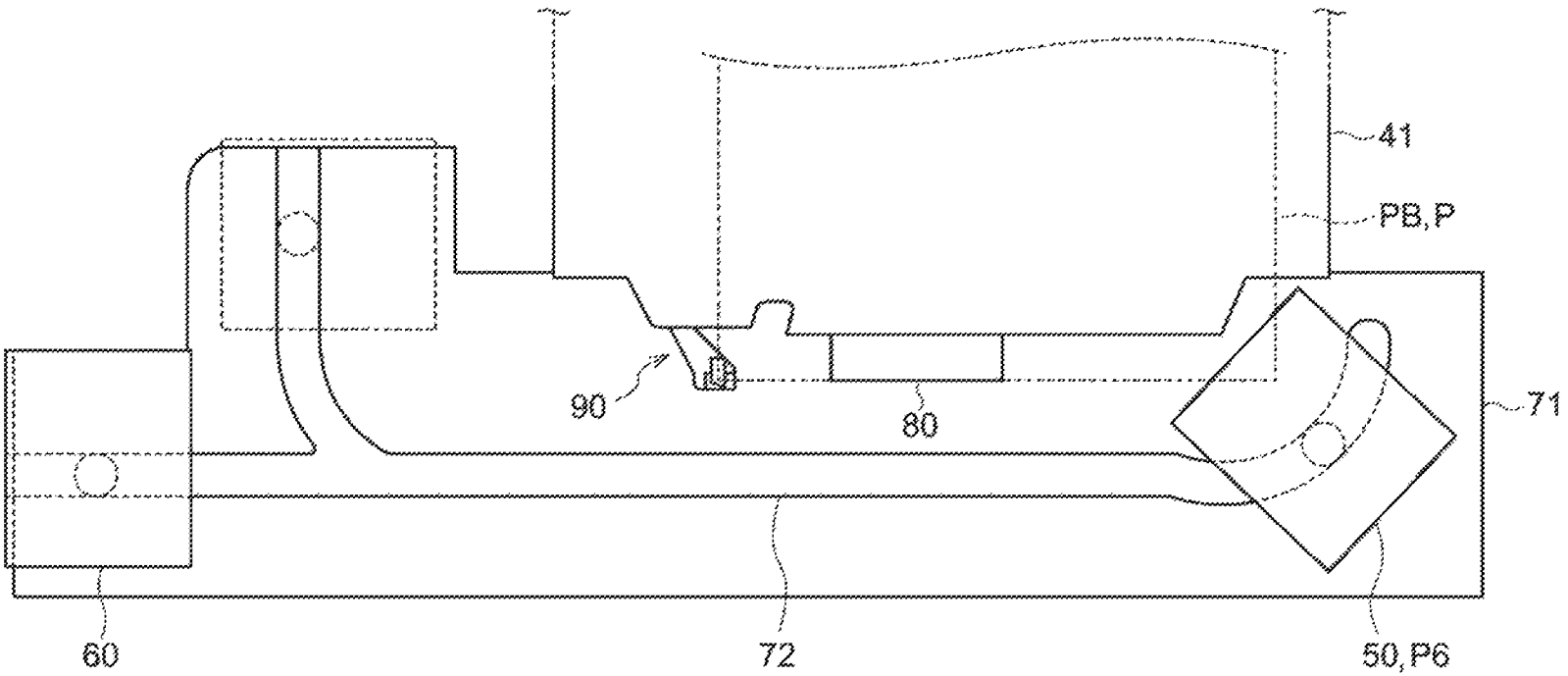
FIG. 6 illustrates operation to obliquely bind a paper bundle using the staple binding member of the binding unit illustrated in FIG. 2.
Figure 7:
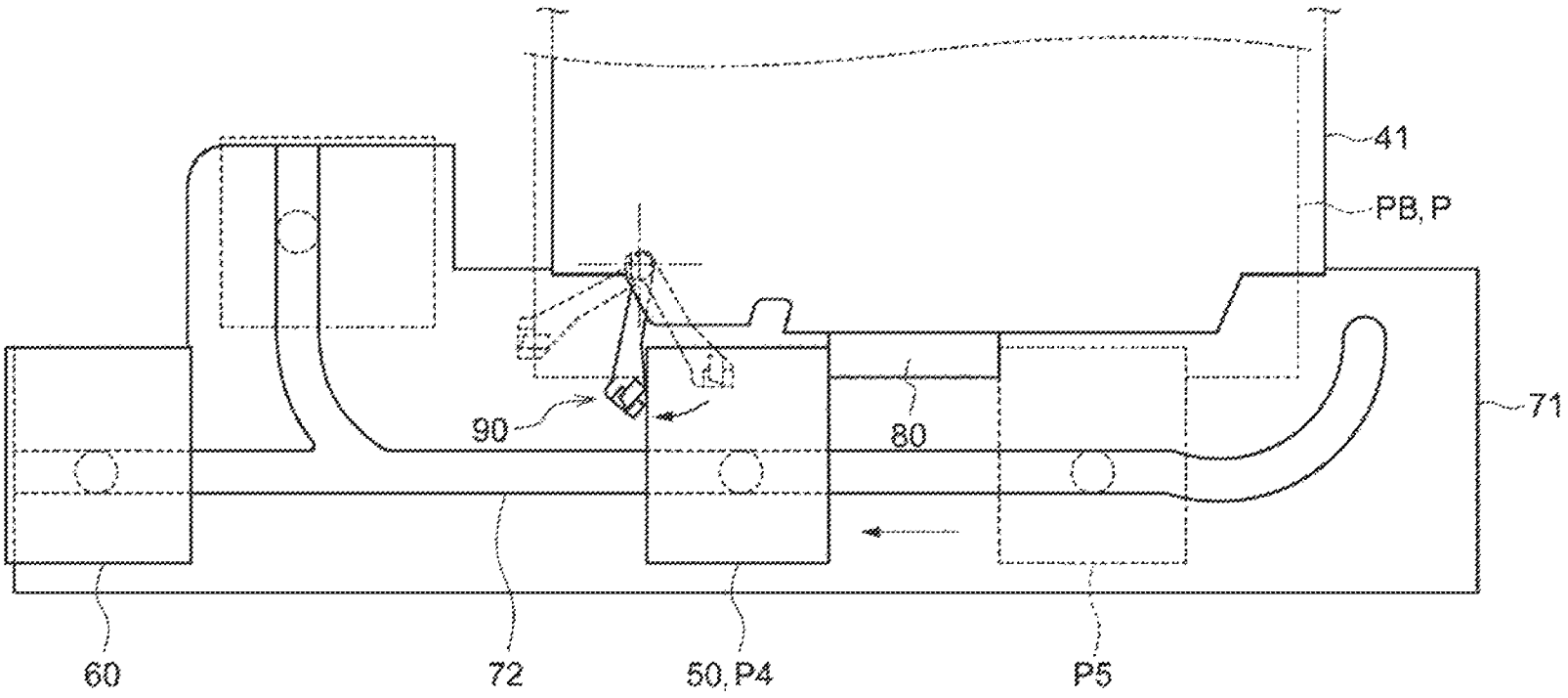
FIG. 7 illustrates operation to flatly bind a paper bundle using the staple binding member of the binding unit illustrated in FIG. 2.

FIG. 6 illustrates operation to obliquely bind a paper bundle using the staple binding member of the binding unit illustrated in FIG. 2. FIG. 7 illustrates operation to flatly bind a paper bundle using the staple binding member of the binding unit illustrated in FIG. 2. In order to describe an example of a sequence of binding operations performed using the staple binding member 50 and the stapleless binding member 60, binding operation by the staple binding member 50 will be described briefly as an example. The home positions of the staple binding member 50 and the stapleless binding member 60 are set to the first stand-by position P2 and the second stand-by position P3, respectively. When oblique binding is performed using the staple binding member 50, as illustrated in FIG. 6, the staple-side drive portion 54 is actuated, with the stapleless binding member 60 standing by at the second stand-by position P3, to move the staple binding member 50 from the first stand-by path 723 by way of the principal guide path 721 to the initial position P1 on the curved path 722, and thereafter the staple binding member 50 is moved to the third binding position P6 to bind the corner portion of the paper bundle PB. When flat binding is performed using the staple binding member 50, as illustrated in FIG. 7, the staple-side drive portion 54 is actuated, with the stapleless binding member 60 standing by at the second stand-by position P3, to move the staple binding member 50 from the first stand-by path 723 by way of the principal guide path 721 to the initial position P1 on the curved path 722, and thereafter the staple binding member 50 is moved to the second binding position P5 to bind the paper bundle PB at a position proximate to a side of the paper bundle PB. Then, the staple binding member 50 is moved to the first binding position P4 to bind the paper bundle PB at a position proximate to the side of the paper bundle PB in the same manner. After the sequence of binding operations is completed, the staple binding member 50 is returned to the first stand-by position P2 to stand by until the next operation instruction.

Next, the structure of the abutment member 42 of the post-processing device according to the present exemplary embodiment will be described. As illustrated in FIGS. 5 to 7, the abutment member 42 according to the present exemplary embodiment includes two members, namely the fixed abutment member 80 and the movable abutment member 90, in order to align a plurality of pieces of paper P in position in the transport direction. The movable abutment member 90 is an example of the positioning portion.

The fixed abutment member 80 is a member, one end of which is attached to generally the center of an end portion of the loading plate 41 on the side on which the binding device 46 is positioned, and the section of which is bent in a generally hook shape. The center portion on the inner side of the fixed abutment member 80, which is bent in a hook shape, constitutes a surface that extends generally perpendicularly to the direction of extension of the upper surface of the loading plate 41. This surface serves as a first abutment surface 81 (see FIG. 9) of the fixed abutment member 80. The pieces of paper P are aligned in position in the transport direction with one side of each of the pieces of paper P abutting against the first abutment surface 81. The arrangement and the size, including the length in the depth direction, of the fixed abutment member 80 are adjusted such that the fixed abutment member 80 does not overlap the positions at which the staple binding member 50 and the stapleless binding member 60 execute binding operation, specifically the staple binding member 50 and the stapleless binding member 60 which are stopped at the first binding position P4 and the second binding position P5, in order not to obstruct binding operation. Specifically, as illustrated in FIG. 5, the size of the fixed abutment member 80 is adjusted such that the fixed abutment member 80 may be disposed in a gap between the first and second binding positions P4 and P5.

As discussed above, the arrangement and the length, in the depth direction, of the fixed abutment member 80 are restricted. Thus, if it is attempted to align the paper bundle PB in position in the transport direction using only the fixed abutment member 80, the paper P may not be positioned reliably, particularly in executing binding operation, with the paper P slanted obliquely, for example, particularly when the paper P is large. In order to address this issue, it is conceivable to additionally provide a member that is similar to the fixed abutment member 80 at a different position from the position at which the fixed abutment member 80 is provided. However, the fixed abutment member 80 may not be disposed at a position that overlaps the positions (in the present exemplary embodiment, the first to third binding positions P4 to P6) at which the staple binding member 50 and the stapleless binding member 60 are stopped to perform binding operation, and thus it is necessary that the additional member should be provided at a position other than such positions. In such a case, the size of the binding unit 40 may be increased. Thus, the abutment member 42 according to the present exemplary embodiment includes the movable abutment member 90 which is disposed at one of the positions at which the staple binding member 50 and the stapleless binding member 60 are stopped to perform binding operation, specifically a position corresponding to the first binding position P4.

Figure 8:
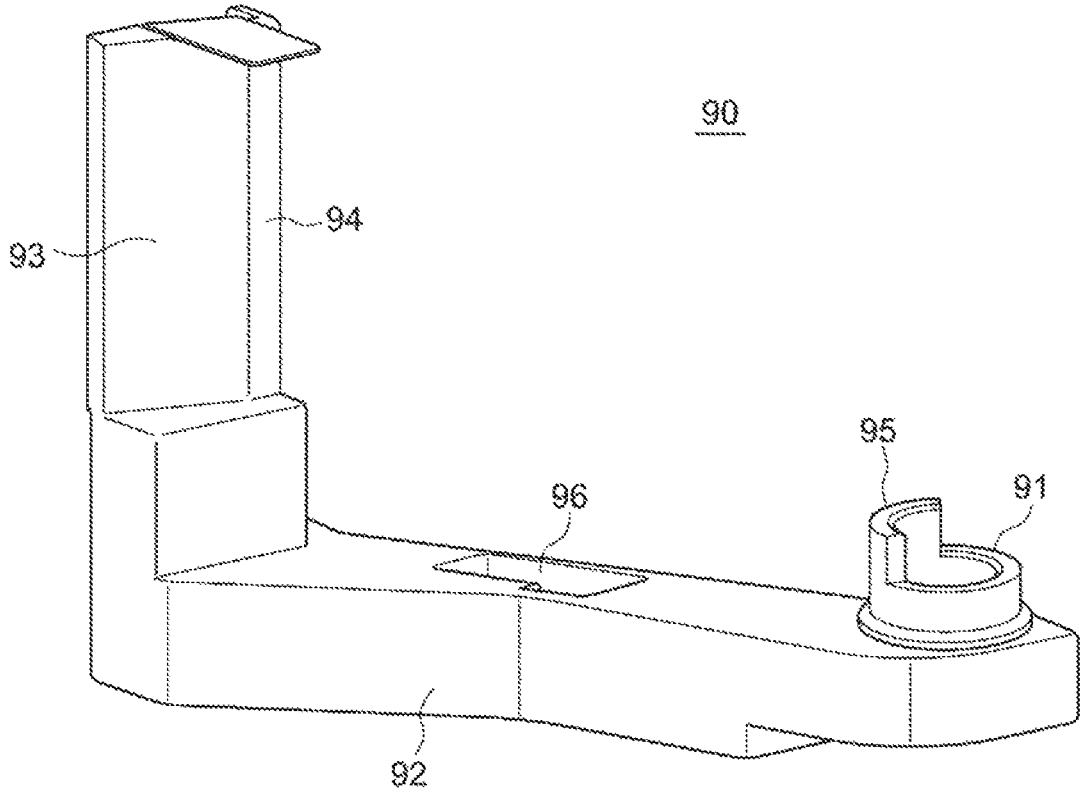
FIG. 8 is a perspective view illustrating a movable abutment member according to the present exemplary embodiment.
Figure 9:
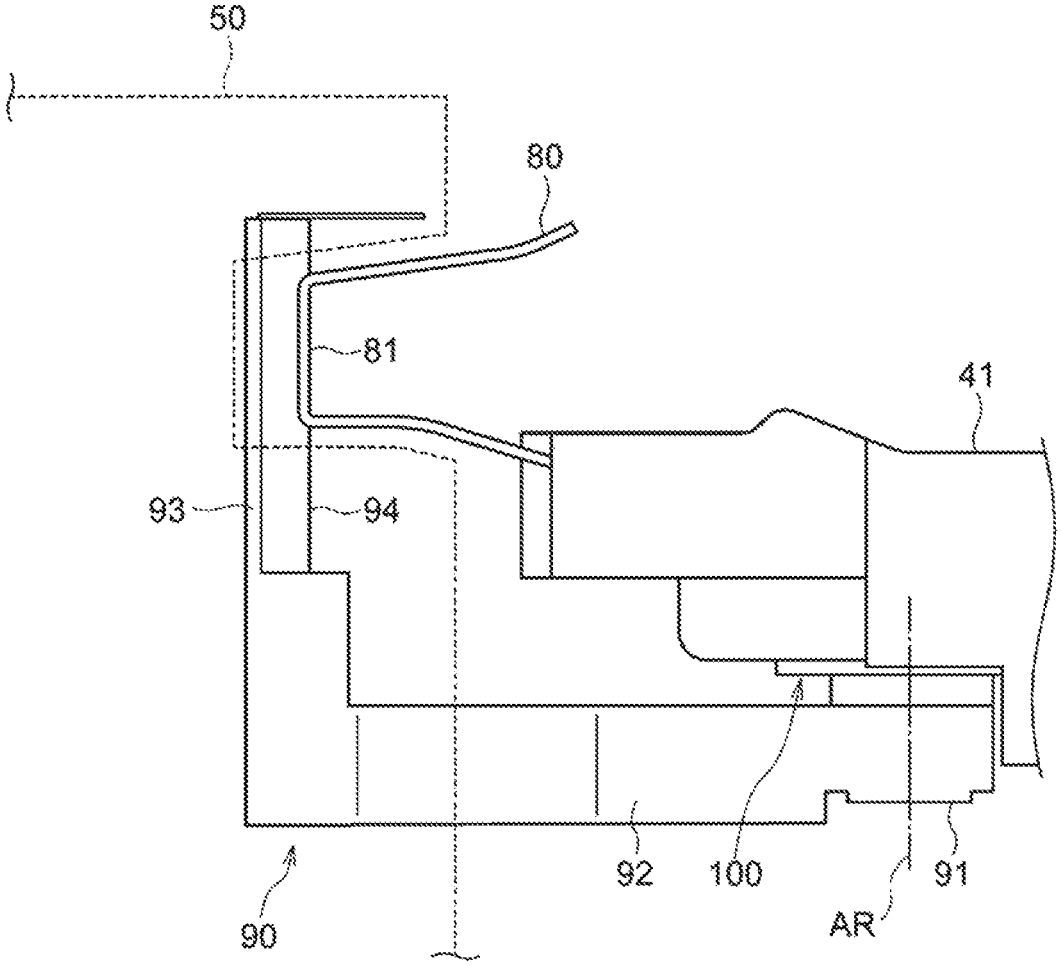
FIG. 9 is a schematic view of an abutment member of the binding unit illustrated in FIG. 2 as seen from the front side in the depth direction.

FIG. 8 is a perspective view illustrating the movable abutment member according to the present exemplary embodiment. FIG. 9 is a schematic view of the abutment member of the binding unit illustrated in FIG. 2 as seen from the front side in the depth direction. In FIG. 9, the track of movement of the staple binding member 50 which is moved along the guide rail 72 is indicated by the dotted line. As illustrated in FIGS. 8 and 9, the movable abutment member 90 according to the present exemplary embodiment may include: a generally annular rotary portion 91 that includes a rotational axis AR; a first arm 92 that extends from a side portion of the rotary portion 91 in a direction intersecting the rotational axis AR; and a second arm 93 which extends from an end portion of the first arm 92 in a direction intersecting the direction of extension of the first arm 92 and on one surface of which a second abutment surface 94 is provided. As illustrated in FIG. 9, the rotary portion 91 is rotatably attached to the lower surface of the loading plate 41 using an attachment bolt 110 (see FIG. 10). The attachment position of the second abutment surface 94 of the movable abutment member 90, which is attached to the loading plate 41, is adjusted such that the first abutment surface 81 of the fixed abutment member 80 and the second abutment surface 94 are aligned in position (in other words, substantially flush) in the transport direction as seen in the depth direction (and the height direction) as illustrated in FIG. 9. The loading plate 41 to which the movable abutment member 90 is attached is an example of the body portion.

When the paper P may be supported in abutment with the second abutment surface 94, the second arm 93, principally, of the movable abutment member 90 configured as discussed above overlaps the track of movement of the staple binding member 50 (or the stapleless binding member 60) as illustrated in FIG. 9. Additionally, a part of the first arm 92 and the second arm 93 of the movable abutment member 90 are provided so as to overlap the first binding position P4 when the paper P may be supported in abutment with the second abutment surface 94. In view of this respect, the movable abutment member 90 according to the present exemplary embodiment is structured so as not to hinder movement of the staple binding member 50 and the stapleless binding member 60. Specifically, the rotary portion 91 of the movable abutment member 90 is rotatably attached to the lower surface of the loading plate 41 so that the movable abutment member 90 is movable between an operation position OP (see FIG. 10), at which the movable abutment member 90 is able to support one side of the paper P on the loading plate 41 together with the fixed abutment member 80, and first and second retracted positions EP1 and EP2 (see FIGS. 12 and 13), at which the entire movable abutment member 90 is retracted outside the track of movement of the staple binding member 50 and the stapleless binding member 60. The word "retracted" refers to a state in which no part of the movable abutment member 90 is positioned to overlap the track of movement of the staple binding member 50 and the stapleless binding member 60 which are moved along the guide rail 72. The first and second retracted positions EP1 and EP2 are in different directions of movement from the operation position OP. Specifically, when the movable abutment member 90 is at the first retracted position EP1, the movable abutment member 90 has been rotated in a first direction toward the back side in the depth direction. When the movable abutment member 90 is at the second retracted position EP2, the movable abutment member 90 has been rotated in a second direction toward the front side in the depth direction. The first retracted position EP1 is an example of the retracted position. The second retracted position EP2 is an example of the second retracted position. The operation position OP is considered to be an example of the stop position.

With the configuration discussed above, the movable abutment member 90 according to the present exemplary embodiment does not obstruct movement of the staple binding member 50 or the stapleless binding member 60 which passes through the first binding position P4 or which is moved toward the first binding position P4. Additionally, the movable abutment member 90 is able to position the paper bundle PB by being positioned at the operation position OP at which the movable abutment member 90 supports one side of the paper bundle PB when the staple binding member 50 or the stapleless binding member 60 is stopped at the binding position P5 or P6, other than the first binding position P4, to perform binding operation. The movable abutment member 90 is rotated about the rotational axis AR, which intersects the plane of the support plate 71, to be movable between the operation position OP and the first and second retracted positions EP1 and EP2.

The movement between the operation position OP and the first and second retracted positions EP1 and EP2 discussed above may also be implemented by a known actuator such as a motor. In the present exemplary embodiment, however, the movable abutment member 90 may be moved without using an actuator. The structure for moving the movable abutment member 90 according to the present exemplary embodiment will be described below.

Figure 10:
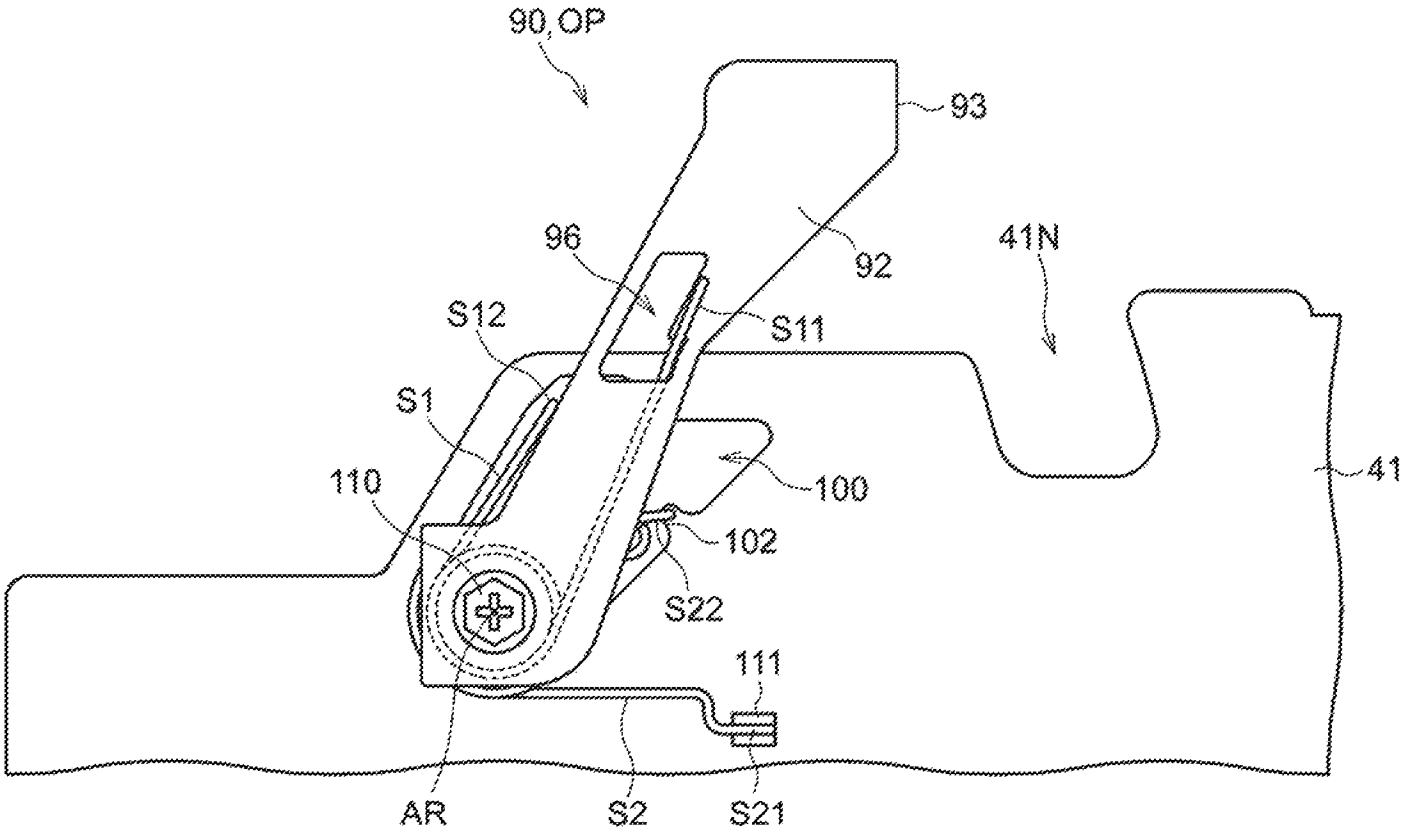
FIG. 10 is an enlarged view, as seen from the lower side, of a portion of a loading plate according to the present exemplary embodiment at which a movable abutment member is attached.
Figure 11:
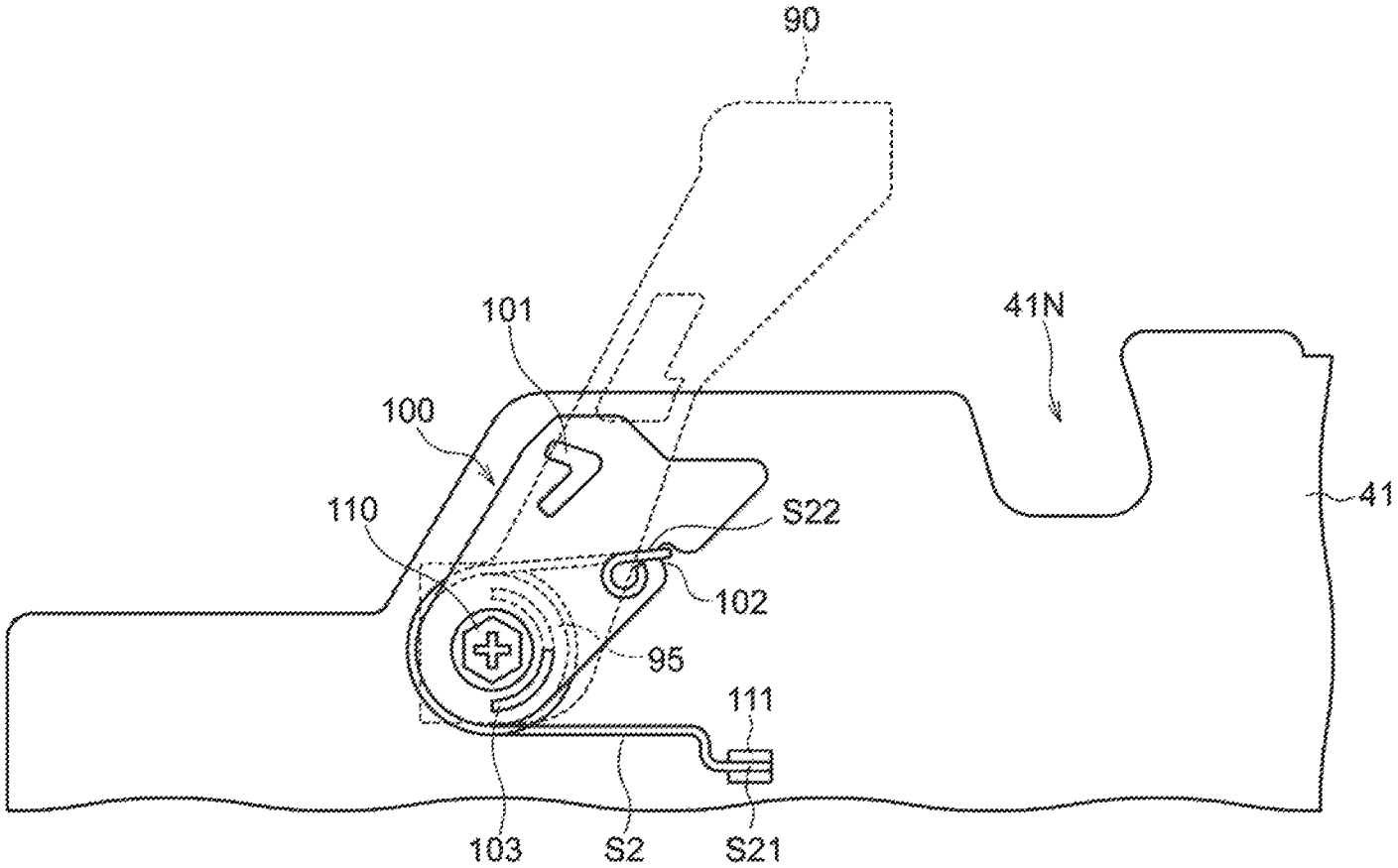
FIG. 11 corresponds to FIG. 10 in which the movable abutment member is illustrated as transparent.

FIG. 10 is an enlarged view, as seen from the lower side, of a portion of the loading plate according to the present exemplary embodiment at which the movable abutment member is attached. FIG. 11 corresponds to FIG. 10 in which the movable abutment member is illustrated as transparent. FIGS. 10 and 11 illustrate a state in which the movable abutment member 90 is positioned at the operation position OP. In FIG. 11, a first torsion spring S1 is not illustrated in order to simplify the illustration. As illustrated in FIGS. 10 and 11, the movable abutment member 90 is rotatably attached to the loading plate 41 via an interposed member 100 interposed therebetween. The interposed member 100 is an example of the interposed portion.

The interposed member 100 may be constituted as a plate-like member that is rotatable relative to both the loading plate 41 and the movable abutment member 90 about the rotational axis AR. The interposed member 100 is attached to the loading plate 41 by the attachment bolt 110 to be rotatable about the rotational axis AR, as with the movable abutment member 90. An interposed member-side interaction projection 103 is provided on a surface of the interposed member 100 on the side adjacent to the movable abutment member 90 at a position adjacent to the rotational axis AR, to cause the interposed member 100 to operate together with the movable abutment member 90. The interposed member-side interaction projection 103 causes the movable abutment member 90 and the interposed member 100 to operate together by being pressed in contact with an abutment member-side interaction projection 95 provided on the rotary portion 91 when the movable abutment member 90 is rotated in the second direction (clockwise direction in FIG. 10).

First and second torsion springs S1 and S2 are disposed between the movable abutment member 90 and the interposed member 100 and between the interposed member 100 and the lower surface of the loading plate 41, respectively. The first and second torsion springs S1 and S2 are disposed such that the rotational axis AR is positioned inside a wound portion of each of the first and second torsion springs S1 and S2. The first torsion spring S1 is an example of the first biasing portion or the biasing portion. The second torsion spring S2 is an example of the second biasing portion or the biasing portion.

As illustrated in FIG. 10, one end S11 of the first torsion spring S1 is fixed to a first spring fixing portion 96 provided on the first arm 92 of the movable abutment member 92, and the other end S12 of the first torsion spring S1 is fixed to a second spring fixing portion 101 provided on the interposed member 100. Consequently, the first torsion spring S1 is formed so as to generate a biasing force that resists a rotational force when the movable abutment member 90 is rotated in the first direction (counterclockwise direction in FIG. 10) with respect to the interposed member 100.

As illustrated in FIG. 11, one end S21 of the second torsion spring S2 is fixed to a third spring fixing portion 111 provided on the lower surface of the loading plate 41, and the other end S22 of the second torsion spring S2 is fixed to a fourth spring fixing portion 102 provided on the interposed member 100. Consequently, the second torsion spring S2 is formed so as to generate a biasing force that resists a rotational force when the interposed member 100 is rotated in the second direction (clockwise direction in FIG. 10) with respect to the lower surface of the loading plate 41.

Both the first and second torsion springs S1 and S2 may be set in advance so as not to generate a biasing force when the movable abutment member 90 is located at the operation position OP indicated in FIGS. 10 and 11. Consequently, the movable abutment member 90 is positioned at the operation position OP when no external force is applied to the movable abutment member 90. The positioning method is not limited thereto. For example, the movable abutment member 90 may be positioned at the operation position OP by adopting a stopper (not illustrated) provided on the interposed member 100 to restrict movement of the movable abutment member 90 in the second direction further than the operation position OP due to the biasing force of the first torsion spring S1 and a stopper (not illustrated) provided on the lower surface of the loading plate 41 to restrict movement of the movable abutment member 90 in the first direction further than the operation position OP due to the biasing force of the second torsion spring S2. In the present exemplary embodiment, two biasing units, namely the first and second torsion springs S1 and S2, are adopted as specific structures for returning the movable abutment member 90 to the operation position OP. However, the present disclosure is not limited thereto. For example, a single biasing unit that applies a restoring force to return the movable abutment member 90 toward the operation position OP when the movable abutment member 90 is moved in a direction away from the operation position OP, irrespective of the direction of movement of the movable abutment member 90, may alternatively be adopted.

Figure 12:
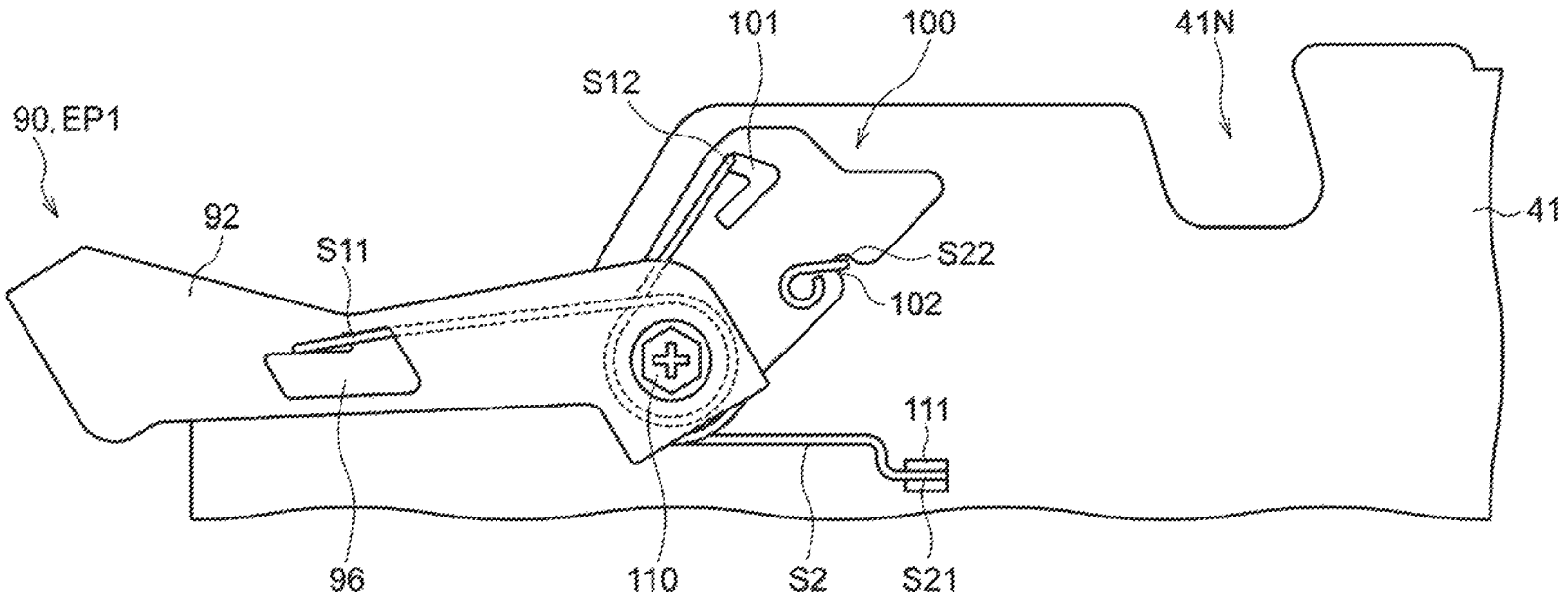
FIG. 12 illustrates a state in which the movable abutment member illustrated in FIG. 10 is rotated in a first direction.

FIG. 12 illustrates a state in which the movable abutment member illustrated in FIG. 10 is rotated in the first direction. When the movable abutment member 90 is rotated by a certain angle in the first direction, specifically in a direction toward the back side in the depth direction, from the operation position OP, the movable abutment member 90 reaches the first retracted position EP1. The second arm 93 of the movable abutment member 90 which is positioned at the first retracted position EP1 is positioned on the side of the transport direction with respect to an end portion of the loading plate 41 positioned on the opposite side from the transport direction. Since no loading plate 41 is provided at the first retracted position EP1, the movable abutment member 90 is able to reach the first retracted position EP1 without contacting the loading plate 41. When the movable abutment member 90 is moved to the first retracted position EP1, the interposed member 100 is not moved as illustrated in FIG. 12. Therefore, the first torsion spring S1, two end portions of which are respectively fixed to the movable abutment member 90 and the interposed member 100, is contracted against the biasing force. Consequently, a restoring force to return the movable abutment member 90 to the operation position OP is applied to the first torsion spring S1.

Figure 13:
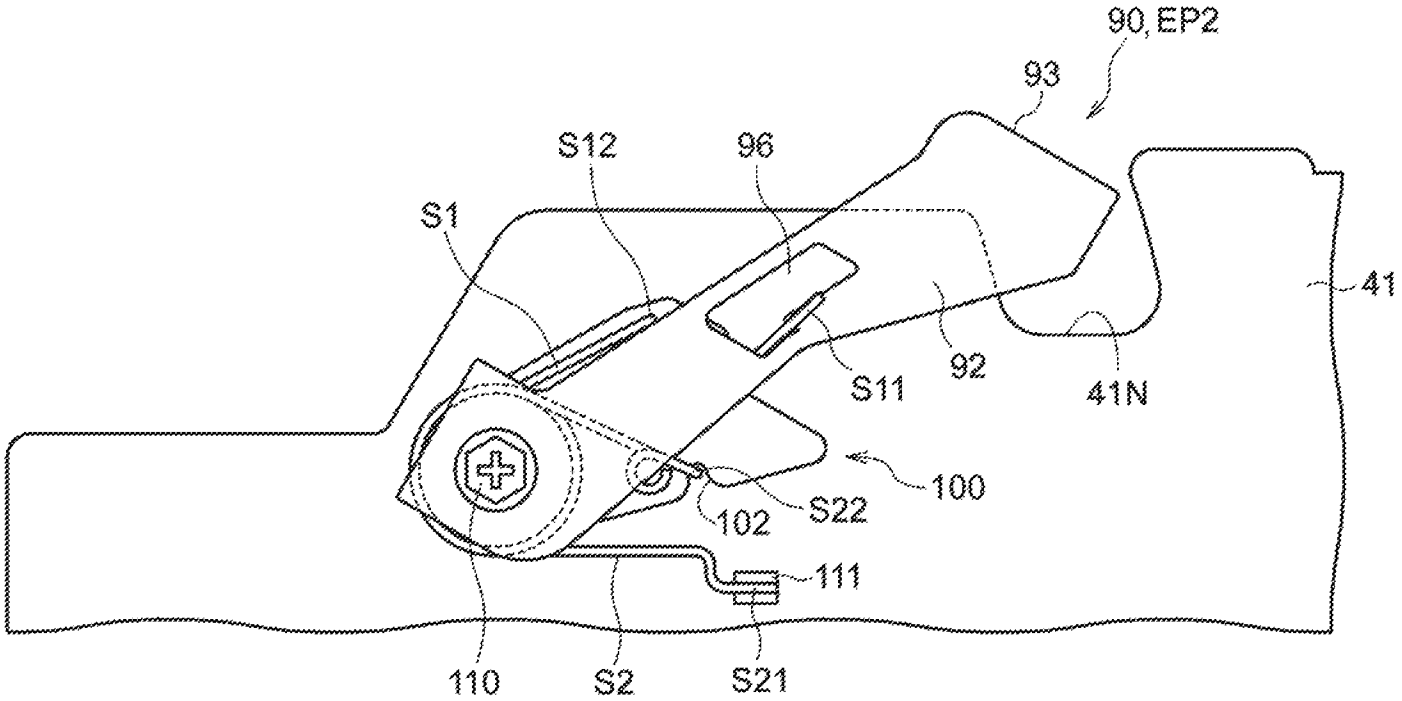
FIG. 13 illustrates a state in which the movable abutment member illustrated in FIG. 10 is rotated in a second direction.

FIG. 13 illustrates a state in which the movable abutment member illustrated in FIG. 10 is rotated in the second direction. When the movable abutment member 90 is rotated by a certain angle in the second direction from the operation position OP, the movable abutment member 90 reaches the second retracted position EP2. The loading plate 41 is provided with a retraction notch 41N at a position corresponding to an end portion of the movable abutment member 90, which is located at the second retracted position EP2, such that the movable abutment member 90 does not contact the loading plate 41. When the movable abutment member 90 is moved to the second retracted position EP2, the abutment member-side interaction projection 95 of the movable abutment member 90 and the interposed member-side interaction projection 103 of the interposed member 100 contact each other, and rotating operation of the movable abutment member 90 is transmitted to the interposed member 100 via a contact portion between the abutment member-side interaction projection 95 and the interposed member-side interaction projection 103, so that the movable abutment member 90 and the interposed member 100 are moved together with each other. Thus, as illustrated in FIG. 13, the second torsion spring S2, two end portions of which are respectively fixed to the lower surface of the loading plate 41 and the interposed member 100, is contracted against the biasing force. Consequently, a restoring force to return the interposed member 100 and the movable abutment member 90, which is moved together with the interposed member 100, to the operation position OP is applied to the second torsion spring S2.

As discussed above, the movable abutment member 90 according to the present exemplary embodiment is moved between the operation position OP and the first and second retracted positions EP1 and EP2 without using an actuator. In the post-processing device according to the present exemplary embodiment, such movement of the movable abutment member 90 is implemented by causing the movable abutment member 90 to positively contact the staple binding member 50 or the stapleless binding member 60 which passes through the first binding position P1, at which the movable abutment member 90 is positioned, or which is moved toward the first binding position P4. Thus, in order to describe the relationship between movement of the staple binding member 50 and the stapleless binding member 60 and movement of the movable abutment member 90, a sequence of operations to flatly bind the paper bundle PB using the stapleless binding member 60 will be described below in association with movement of the movable abutment member 90. In the following description, the paper bundle PB is flatly bound using the stapleless binding member 60. However, the movable abutment member 90 is moved in the same manner also when the paper bundle PB is flatly bound using the staple binding member 50.

Figure 14:
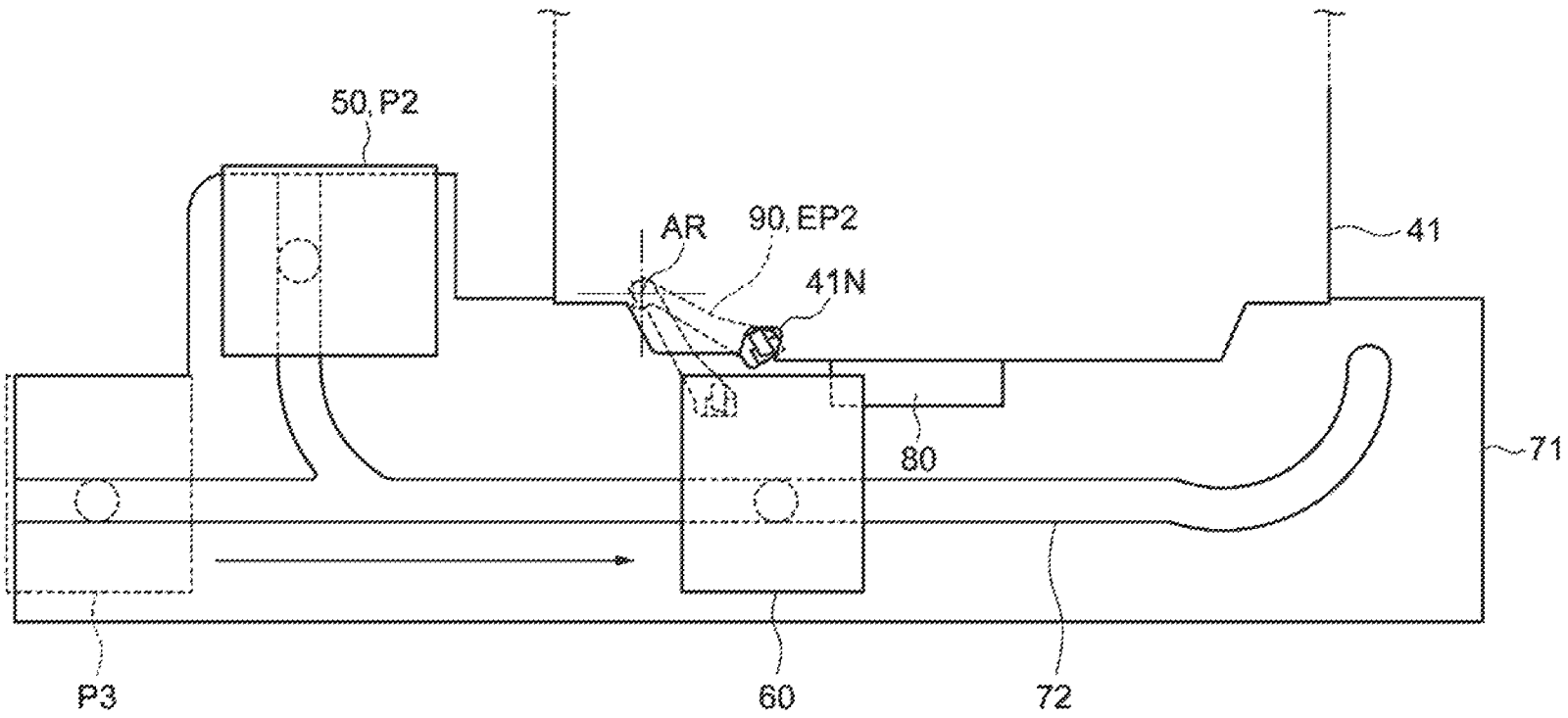
FIG. 14 illustrates a first state for describing operation to flatly bind a paper bundle using the stapleless binding member of the binding unit illustrated in FIG. 2.

FIG. 14 illustrates a first state for describing operation to flatly bind a paper bundle using the stapleless binding member of the binding unit illustrated in FIG. 2. When an image forming process is executed in the image forming apparatus 1, first, operation to move the stapleless binding member 60 from the second retracted position P3 to the initial position P1 is executed before the paper P is transported onto the loading plate 41. When the stapleless binding member 60 is moved from the second retracted position P3 to the initial position P1, the stapleless binding member 60 passes through the first binding position P4. Thus, an end surface, on the front side in the depth direction, of the stapleless binding member 60, which passes through the first binding position P4, contacts an end surface, on the back side in the depth direction, of the second arm 92 of the movable abutment member 90 which is located at the operation position OP. As discussed above, the movable abutment member 90 is elastically supported at the operation position OP by the first and second torsion springs S1 and S2. Thus, as illustrated in FIG. 14, the movable abutment member 90 which has contacted the stapleless binding member 60 is pushed by the stapleless binding member 60 to be rotated from the operation position OP toward the second retracted position EP2. When the stapleless binding member 60 is moved from the state discussed above and the movable abutment member 90 is pushed until reaching the second retracted position EP2, contact between an end surface of the stapleless binding member 60 on the front side in the depth direction and the movable abutment member 90 is canceled, and rotation of the movable abutment member 90 is stopped.

Figure 15:
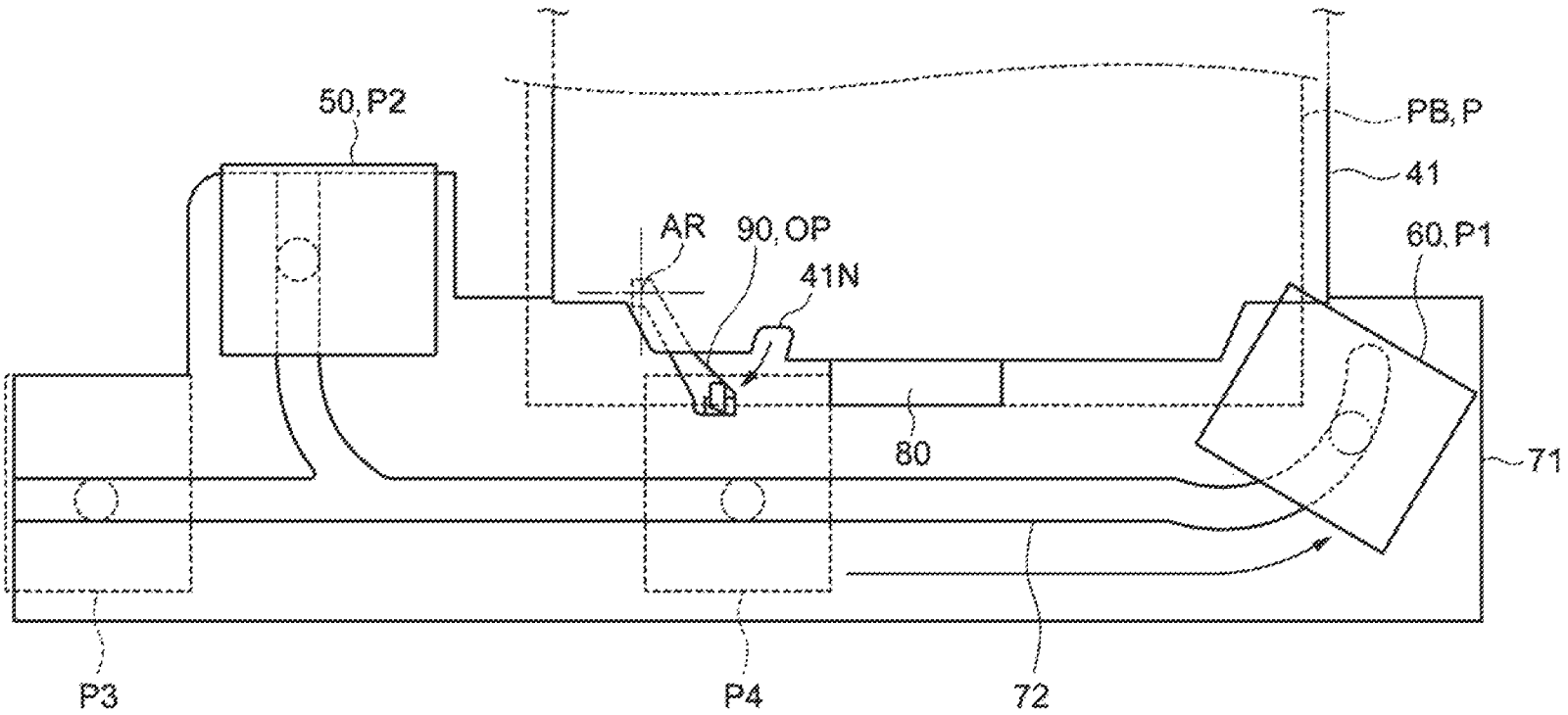
FIG. 15 illustrates a second state for describing operation to flatly bind a paper bundle using the stapleless binding member of the binding unit illustrated in FIG. 2.

FIG. 15 illustrates a second state for describing operation to flatly bind a paper bundle using the stapleless binding member of the binding unit illustrated in FIG. 2. When the stapleless binding member 60 is further moved from the state discussed above and the stapleless binding member 60 has completely passed through the first binding position P4, the movable abutment member 90 is biased by the restoring force of the second torsion spring S2 to return from the second retracted position EP2 to the operation position OP as illustrated in FIG. 15. Then, the stapleless binding member 60 reaches the initial position P1.

When the stapleless binding member 60 reaches the initial position P1 after passing through the first binding position P4, the paper P is stacked on the loading plate 41. In this event, the movable abutment member 90 has been returned to the operation position OP by the restoring force of the second torsion spring S2 as discussed above, and therefore an end portion (one side positioned on the opposite side from the transport direction) of the paper P which has been transported onto the loading plate 41 abuts against the first abutment surface 81 of the fixed abutment member 80 and the second abutment surface 94 of the movable abutment member 90 because of the weight of the paper P itself and the action of the paddle 43 to be aligned in position in the transport direction. When a specific number of pieces of paper P are stacked on the loading plate 41, the stapleless binding member 60 starts flat binding operation. When flat binding operation is started, the stapleless binding member 60 is first moved from the initial position P1 toward the second binding position P5, and executes binding operation at the second binding position P5 to form a first bound portion BP on the paper bundle PB. It should be particularly noted that the movable abutment member 90 remains located at the operation position OP even at the timing when the binding operation is executed. Consequently, the binding operation performed by the stapleless binding member 60 at the second binding position P5 may be executed with an end surface of the paper bundle PB supported in abutment with both the fixed abutment member 80 and the movable abutment member 90. In the present exemplary embodiment, as discussed above, when the staple binding member 50 or the stapleless binding member 60 performs binding operation, binding operation is performed with the staple binding member 50 or the stapleless binding member 60 moved to a specific binding position after being moved to the initial position P1. However, movement to the initial position P1, among the sequence of operations, is optional. For example, the stapleless binding member 60 may not be moved to the initial position P1 after the stapleless binding member 60 has completely passed through the first binding position P1 in the course of the movement discussed above, and movement of the stapleless binding member 60 toward the front side in the depth direction may be stopped at the time when the stapleless binding member 60 has reached the second binding position P5. In this case, the first bound portion BP may be formed by the stapleless binding member 60 executing binding operation at the stage when the paper P is completely stacked.

Figure 16:
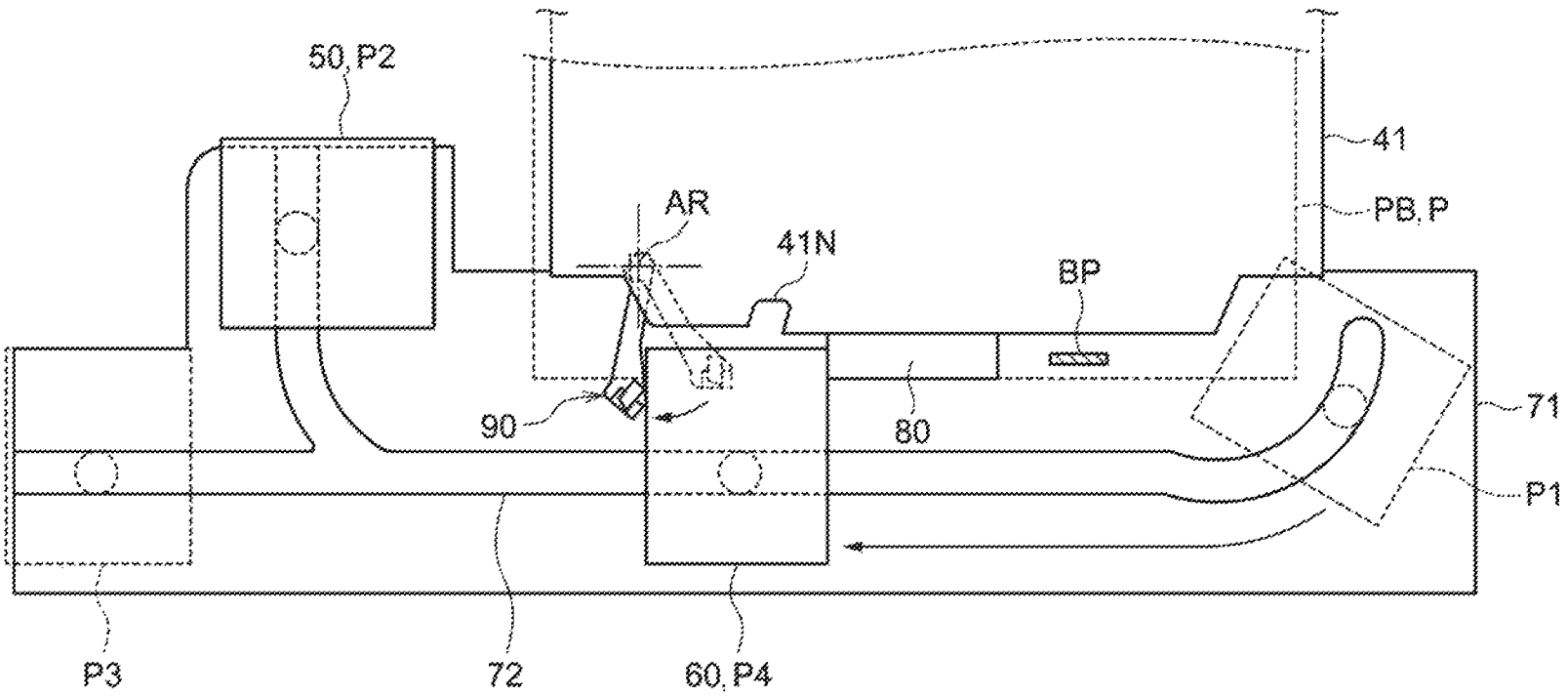
FIG. 16 illustrates a third state for describing operation to flatly bind a paper bundle using the stapleless binding member of the binding unit illustrated in FIG. 2.

FIG. 16 illustrates a third state for describing operation to flatly bind a paper bundle using the stapleless binding member of the binding unit illustrated in FIG. 2. When binding operation at the second binding position P5 is completed, the stapleless binding member 60 is next moved from the second binding position P5 toward the first binding position P4. In the course of this movement, an end surface, on the back side in the depth direction, of the stapleless binding member 60, contacts an end surface, on the front side in the depth direction, of the second arm 92 of the movable abutment member 90 which is located at the operation position OP. As illustrated in FIG. 16, the movable abutment member 90 which has contacted the stapleless binding member 60 is pushed by the stapleless binding member 60 to be rotated from the operation position OP toward the first retracted position EP1. As a result of this rotating operation, support of an end portion (one side positioned on the opposite side from the transport direction) of the paper bundle PB by the movable abutment member 90 is canceled. It should be noted that the attachment position of the movable abutment member 90 according to the present exemplary embodiment has been adjusted such that the movable abutment member 90 does not contact the paper bundle PB stacked on the loading plate 41 when the movable abutment member 90 is rotated from the operation position OP toward the first retracted position EP1. Specifically, the movable abutment member 90 is attached such that the position of the second arm 92 in the depth direction is on the front side with respect to the position of the rotational axis AR in the depth direction when the movable abutment member 90 is located at the operation position OP. By adopting such an attachment structure, the second arm 92 of the movable abutment member 90, which is rotated by being pushed by an end surface of the stapleless binding member 60 on the back side in the depth direction, is rotated while being spaced away from an end portion of the paper bundle PB.

When the stapleless binding member 60 is further moved to reach the first binding position P4 while pushing the movable abutment member 90 toward the back side in the depth direction, the stapleless binding member 60 execute binding operation at the first binding position P4 to form a second bound portion BP on the paper bundle PB. Support of an end portion of the paper bundle PB by the movable abutment member 90 has been canceled when binding operation is performed by the stapleless binding member 60 at the first binding position P4.

Figure 17:
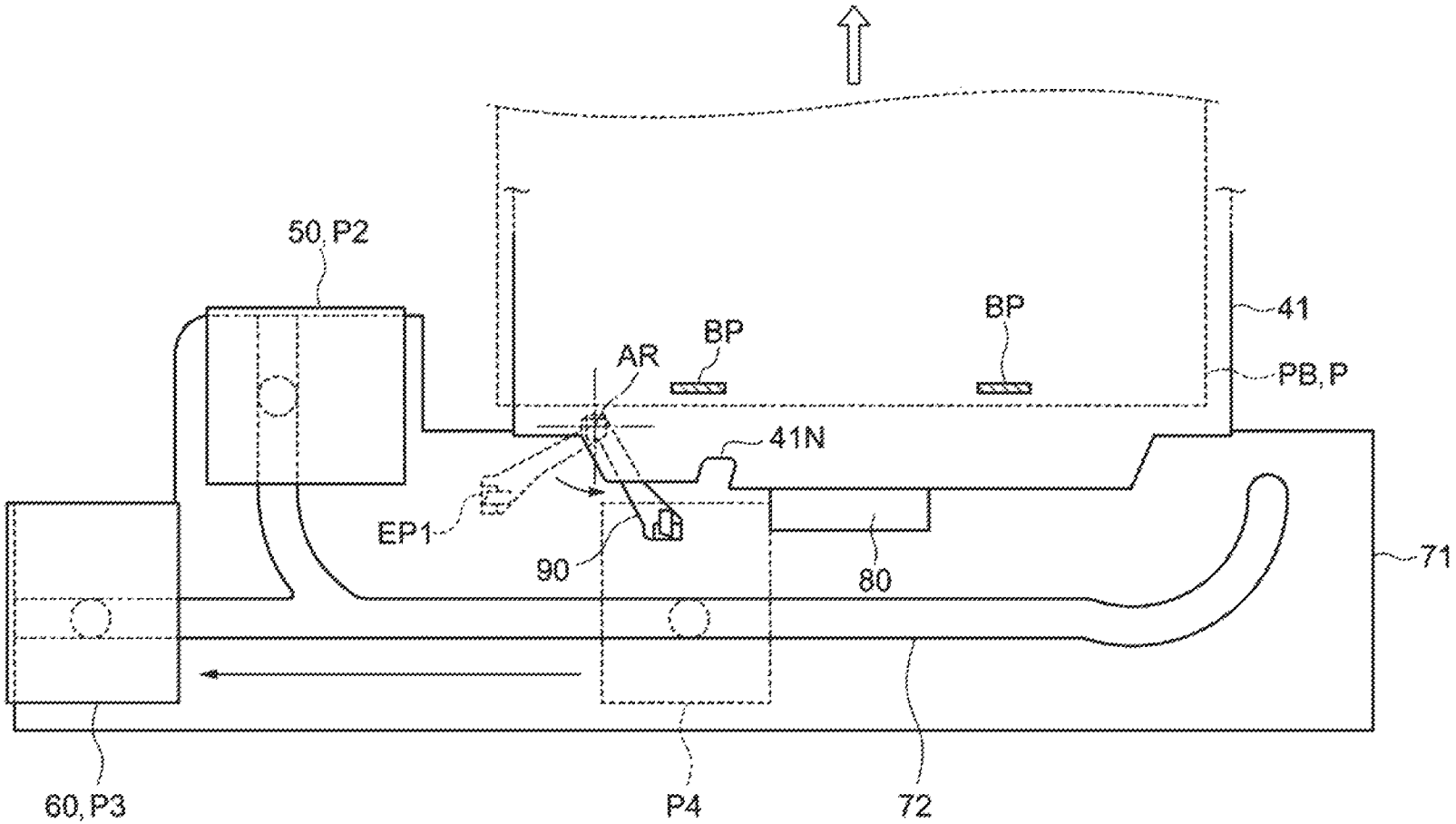
FIG. 17 illustrates a fourth state for describing operation to flatly bind a paper bundle using the stapleless binding member of the binding unit illustrated in FIG. 2.

FIG. 17 illustrates a fourth state for describing operation to flatly bind a paper bundle using the stapleless binding member of the binding unit illustrated in FIG. 2. When binding operation at the first binding position P4 is completed, the paper bundle PB which has been bound is transported to the ejection section 32 by the ejection roller 45, and the stapleless binding member 60 is moved to be returned to the second stand-by position P3. When the stapleless binding member 60 is moved from the first binding position P4 to the second stand-by position P3, the movable abutment member 90 is pushed by the stapleless binding member 60 to be rotated toward the first retracted position EP1. When the stapleless binding member 60 is moved and the movable abutment member 90 is pushed until reaching the first retracted position EP1, contact between an end surface of the stapleless binding member 60 on the back side in the depth direction and the movable abutment member 90 is canceled, and rotation of the movable abutment member 90 is stopped. When the stapleless binding member 60 is further moved from the state discussed above and the stapleless binding member 60 has completely passed through the first binding position P4, the movable abutment member 90 is biased by the restoring force of the first torsion spring S1 to return from the first retracted position EP1 to the operation position OP as illustrated in FIG. 17. Then, the stapleless binding member 60 is returned to the second stand-by position P3.

While the post-processing device and the image forming apparatus according to an exemplary embodiment of the present disclosure have been described above, the post-processing device and the image forming apparatus according to the present disclosure are not limited to the configuration discussed above, and may be modified, as appropriate, in such a range that the functions thereof may be maintained. Specific examples follow. While the staple binding member 50 and the stapleless binding member 60 are adopted as two post-processing sections in the post-processing device according to the exemplary embodiment, a different post-processing section (e.g. a post-processing section that performs a punching process) may be adopted in combination therewith. For example, two staple binding members that use staples of different sizes may be adopted.

The post-processing device according to the exemplary embodiment includes two post-processing sections, namely the staple binding member 50 and the stapleless binding member 60. However, the post-processing device may include only one post-processing section. In the case where the post-processing device includes only one post-processing section, e.g. the staple binding member 50, it is not necessary to provide the movable body support member 70 with the first and second stand-by portions 713 and 714. In this case, the stand-by position (so-called home position) for the staple binding member 50 when not in use is preferably the initial position P1.

The movable abutment member 90 according to the exemplary embodiment is provided at only one position corresponding to the first binding position P4. However, the movable abutment member 90 may be provided at a different binding position, e.g. a position corresponding to the second binding position P5, or at two locations, namely a position corresponding to the first binding position P4 and a position corresponding to the second binding position P5. Further, the post-processing device according to the present exemplary embodiment adopts two types of members, namely the fixed abutment member 80 and the movable abutment member 90, as the abutment member 42. However, the abutment member 42 may be formed from one or more movable abutment members 90 alone.

The movable abutment member 90 according to the exemplary embodiment is attached to the lower surface of the loading plate 41. However, the movable abutment member 90 may be attached to a different member, such as a part of the movable body support member 70, for example. The attachment position of the movable abutment member 90 may be modified, as appropriate, within such a range that the function thereof may be maintained.

The present disclosure is not limited to the exemplary embodiment discussed above, and may be implemented with a variety of modifications without departing from the scope and spirit of the present disclosure. All such modifications are included in the technical idea of the present disclosure.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A post-processing device comprising:

a passage that extends in one direction;

a post-processing section that is movable on a plane along the passage and that is configured to stop at a plurality of post-processing positions, including a stop position determined in advance, to perform post-processing on a recording medium;

a positioning portion at the stop position and against which an end portion of the recording medium abuts when the post-processing section performs the post-processing at a post-processing position other than the stop position, the positioning portion being configured to retract with respect to the post-processing section when the post-processing section passes through the stop position or is moved toward the stop position, wherein the positioning portion is configured to retract to a retracted position by contacting the post-processing section being moved from one side to the other side in the one direction with respect to the stop position, and to a second retracted position by contacting the post-processing section being moved from the other side to the one side in the one direction;

a body portion;

an interposed portion that is rotatable relative to both the body portion and the positioning portion about a rotational axis that intersects the plane; and a biasing member that includes a first biasing portion between the positioning portion and the interposed portion to apply a restoring force directed to the stop position to the positioning portion when retracted to the retracted position; and a second biasing portion between the body portion and the interposed portion to apply, via the interposed portion, a restoring force directed to the stop position to the positioning portion when retracted to the second retracted position.

2. The post-processing device according to claim 1, wherein the positioning portion is configured to be retracted by being rotated about a rotational axis that intersects the plane.

3. The post-processing device according to claim 2, further comprising:

a second post-processing section that is movable on the plane along the passage and that is configured to stop at a plurality of positions, including the stop position, to perform post-processing, which is different from the post-processing performed by the post-processing section, on the recording medium, wherein a stand-by position of the post-processing section is along a direction that intersects the one direction from an end portion of the passage on the other side in the one direction, a second stand-by position of the second post-processing section is further on the other side from the end portion of the passage on the other side in the one direction, an initial position at which the post-processing section or the second post-processing section starts the post-processing is closer to the end portion of the passage on the one side than to the end portion of the passage on the other side in the one direction and is different from the post-processing position, the post-processing section is configured to perform the post-processing after being moved to the initial position when the second post-processing section is standing by at the second stand-by position, the second post-processing section is configured to perform the post-processing after being moved to the initial position when the post-processing section is standing by at the stand-by position, and an end portion of the recording medium abuts against the positioning portion when the post-processing section or the second post-processing section performs the post-processing at a post-processing position other than the stop position, and the positioning portion is configured to be retracted with respect to the post-processing section or the second post-processing section when the post-processing section or the second post-processing section passes through the stop position or is moved toward the stop position.

4. The post-processing device according to claim 1, further comprising:

a second post-processing section that is movable on the plane along the passage and that is configured to stop at a plurality of positions, including the stop position, to perform post-processing, which is different from the post-processing performed by the post-processing section, on the recording medium, wherein a stand-by position of the post-processing section is along a direction that intersects the one direction from an end portion of the passage on the other side in the one direction, a second stand-by position of the second post-processing section is further on the other side from the end portion of the passage on the other side in the one direction, an initial position at which the post-processing section or the second post-processing section starts the post-processing is closer to the end portion of the passage on the one side than to the end portion of the passage on the other side in the one direction and is different from the post-processing position, the post-processing section is configured to perform the post-processing after being moved to the initial position when the second post-processing section is standing by at the second stand-by position, the second post-processing section is configured to perform the post-processing after being moved to the initial position when the post-processing section is standing by at the stand-by position, and an end portion of the recording medium abuts against the positioning portion when the post-processing section or the second post-processing section performs the post-processing at a post-processing position other than the stop position, and the positioning portion is configured to be retracted with respect to the post-processing section or the second post-processing section when the post-processing section or the second post-processing section passes through the stop position or is moved toward the stop position.

5. An image forming apparatus comprising:

an image forming unit that is configured to transport a recording medium and form an image on the recording medium; and the post-processing device according to claim 1, which is downstream of the image forming unit in a transport direction of the recording medium.

* * * * *